United States Patent [19]

Konopeskas

[11] 4,036,566

[45] July 19, 1977

[54] FLUID DISPLACEMENT APPARATUS

[76] Inventor: Leon A. Konopeskas, London, Canada

[21] Appl. No.: 573,946

[22] Filed: May 2, 1975

[30] Foreign Application Priority Data

May 7, 1974 Canada ..... 199185

[51] Int. Cl.[2] ..... F01C 3/06; F04C 3/00; F01C 1/00; F02B 55/14

[52] U.S. Cl. ..... 418/68; 418/164; 123/8.45

[58] Field of Search ..... 418/68, 163, 164, 172; 123/8.45, 43 B, 43 R

[56] References Cited

U.S. PATENT DOCUMENTS

| | | | |
|---|---|---|---|
| 228,906 | 6/1880 | Krupp | 418/163 |
| 453,652 | 6/1891 | Morgan | 418/163 |
| 931,077 | 8/1909 | McQuown | 418/163 |
| 1,376,397 | 5/1921 | Bygler | 418/164 |
| 2,043,544 | 6/1936 | Kempthorne | 123/43 R |
| 3,702,602 | 11/1972 | Lotesto | 418/68 |

*Primary Examiner*—John J. Vrablik
*Assistant Examiner*—Donald S. Holland
*Attorney, Agent, or Firm*—Cushman, Darby & Cushman

[57] ABSTRACT

This invention relates to a fluid displacement apparatus and, more particularly, to fluid displacement apparatus which, with suitable modifications, can be used as a pump, compressor, pneumatic or hydraulic motor or as an internal combustion engine. The fluid displacement apparatus includes a body having a chamber defined therein. At least a portion of the inner surface of such chamber is in the form of a concave segment. Partition means are sealingly engaged with said chamber and define an enclosed space therewith. A baffle extends through said partition means in sealing engagement therewith and is movable relative thereto. The baffle has a peripheral edge shaped to sealingly engage said inner surface of said chamber in relatively movable relation thereto such that said baffle is capable of sweeping motion to and fro relative to said chamber whereby to vary the volumes of the regions located between said inner surface and said partition on the opposing sides of said baffle. Port means and valve means communicate with said chamber for permitting or effecting inflow and outflow of fluid from said chamber in a desired fashion during the occurrence of said sweeping motion of said baffle relative to said chamber. Rotatable shaft means are operatively connected to said baffle and/or said chamber for rotation of said shaft means about an axis during said sweeping motion of the baffle relative to said chamber whereby the sweeping motion of the baffle relative to the chamber effects rotation of the shaft means or vice versa.

9 Claims, 10 Drawing Figures

FLUID DISPLACEMENT APPARATUS

This invention relates to a fluid displacement apparatus and, more particularly, to fluid displacement apparatus which, with suitable modifications, can be used as a pump, compressor, pneumatic or hydraulic motor or as an internal combustion engine.

Those skilled in the art are well aware of the fact that over the past number of years many different designs of pumps and engines have evolved. One of the most common types of fluid displacement apparatus is of course the reciprocating piston and cylinder pump or engine employing the well known connecting rod and crank shaft arrangement for effecting reciprocation of the piston, in the case of a pump or, in the case of an engine, for transmitting thrust forces from the piston to an output shaft. This type of an arrangement, although extremely successful, has presented designers in the past with many problems insofar as achieving dynamic balance is concerned and also in the number of moving parts which must be employed. In an effort to overcome some of the inherent deficiencies in the conventional reciprocating piston and cylinder engine, so-called "rotary" engines were developed, the most successful of these being so-called "Wankel" rotary engine which has just come into commercial production within the last few years. The commercial adoption of the "Wankel" design was delayed for many years pending the solution of numerous problems including providing adequate sealing means within the engine to prevent "blow by" of gases as well as numerous other problems relating to proper transfer of heat from the rotor to the engine casing.

It is an object of the present invention to provide an improved fluid displacement device capable of being used in the manner described above which employs a minimum number of moving parts, wherein wear and friction problems are held to a minimum; and wherein clearances between moving parts can be set and controlled accurately; it is also a further object to provide a fluid displacement apparatus of the character described which can readily be dynamically balanced.

Accordingly, the present invention provides a novel type of fluid displacement apparatus, one of the characterizing features of which includes the use of a baffle means arranged within a chamber, with such baffle means being sealingly engaged with the inner surfaces of the chamber with the baffle being arranged for sweeping motion to and fro within the chamber during operation so as to achieve a fluid displacement effect.

More particularly, the present invention provides, in one aspect, a fluid displacement apparatus comprising a body having a chamber defined therein. At least a portion of the inner surface of such chamber is in the form of a concave segment. Partition means are sealingly engaged with said chamber and define an enclosed space therewith. A baffle extends through said partition means in sealing engagement therewith and is movable relative thereto. The baffle has a peripheral edge shaped to sealingly engage said inner surface of said chamber in relatively movable relation thereto such that said baffle is capable of sweeping motion to and fro relative to said chamber whereby to vary the volumes of the regions located between said inner surface and said partition on the opposing sides of said baffle. Port means and valve means communicate with said chamber for permitting or effecting inflow and outflow of fluid from said chamber in a desired fashion during the occurrence of said sweeping motion of said baffle relative to said chamber. Rotatable shaft means are operatively connected to said baffle and/or said chamber for rotation of said shaft means about an axis during said sweeping motion of the baffle relative to said chamber whereby the sweeping motion of the baffle relative to the chamber effects rotation of the shaft means or vice versa.

In a further aspect said inner chamber surface is in the form of a concave spherical segment.

In accordance with a further aspect of the invention, said baffle is connected to said partition means by pivot means defining intersecting pivot axes mutually perpendicular to one another.

In one form of the invention, both the baffle and the body rotate together about mutually inclined axes; in another variation the body is fixed and the rotatable shaft means is operatively connected to the baffle; in a still further variant the baffle is stationary and the moving body is operatively connected to the rotatable shaft means.

In a still further aspect of the invention the apparatus includes means mounting said body for rotation about an axis, said baffle being rotatable having its rotation axis angularly inclined to the rotation axis of said body whereby said body and said baffle rotate simultaneously about their respective angularly inclined axes with said sweeping motion of said baffle within said chamber occurring during said rotation of the body and the baffle.

In a still further feature of the invention the angularly inclined rotation axes of the body and the baffle intersect at a point coincident with the point of intersection of the mutually perpendicular pivot axes defined by said pivot means.

In the preferred embodiment of the invention the pivot means comprises an elongated shaft mounted in the partition means for angular motion therein about a first one of the mutually perpendicular axes. The elongated shaft has a longitudinally extending slot therein through which the baffle passes in sealing relation therewith. A pivot pin extends transversely of said slot and passes through the baffle and is engaged in the elongated shaft for oscillation of the baffle thereabout during operation of the apparatus.

In a further aspect of the invention the fluid displacement apparatus may comprise a two-cycle internal combustion engine. In this case the port means includes a valved intake port for a fuel-air mixture which communicates with one of said regions on one side of the baffle. An intermediate conduit is provided for passing fuel-air mixture from said one region to the other region during a portion of the sweeping motion of the baffle. An exhaust port communicates with said other region for releasing spent combustion gases therefrom after combustion of and expansion of said gases with the expansion of the gases acting on the baffle to effect said sweeping motion of same relative to said chamber and consequent rotation of the shaft means about its rotation axis.

In a further form of the invention, the fluid displacement apparatus may comprise a four-cycle internal combustion engine in which case the port means include a valved fuel-air intake port and a valved exhaust port, both communicating with one of said regions. Means are provided for igniting a compressed fuel-air mixture in said one region to effect combustion of and expansion of said gases with such expansion of the gases effecting sweeping motion of the baffle means relative to said chamber.

The two and four cycle engines may be modified for use with fuel injection systems and for operation as either gasoline or diesel engines.

As indicated above the fluid displacement apparatus may also comprise a fluid pump in which case the port means includes an intake port having a one-way valve for admission of fluid into at least one of said regions during sweeping motion of said baffle relative to the chamber in one direction, and an exhaust port having a one-way valve for allowing exit of fluid from said at least one region during the relative sweeping motion in the opposite direction. Multistage compression (up to four stages) is possible, provided suitable modifications are made.

Illustrative embodiments of the invention will now be described by way of example with reference being had to the accompanying drawings in which.

Figure 1:
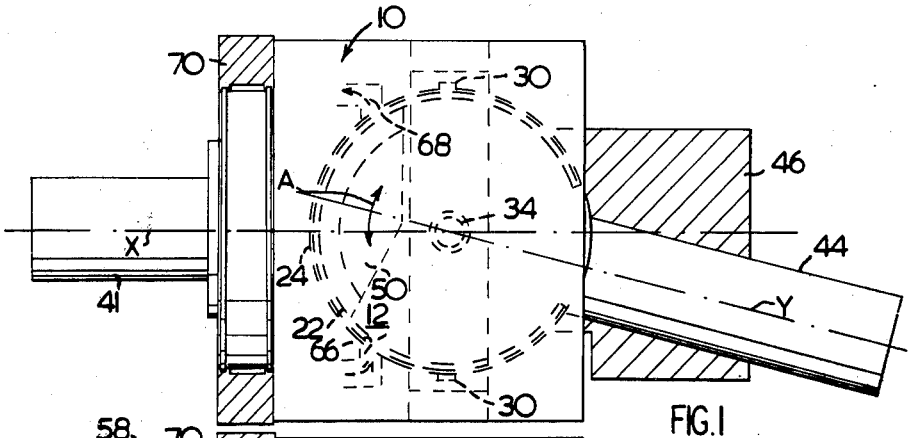
FIG. 1 is a plan view, partly in section, of a two-cycle engine incorporating the principles of the invention.
Figure 2:
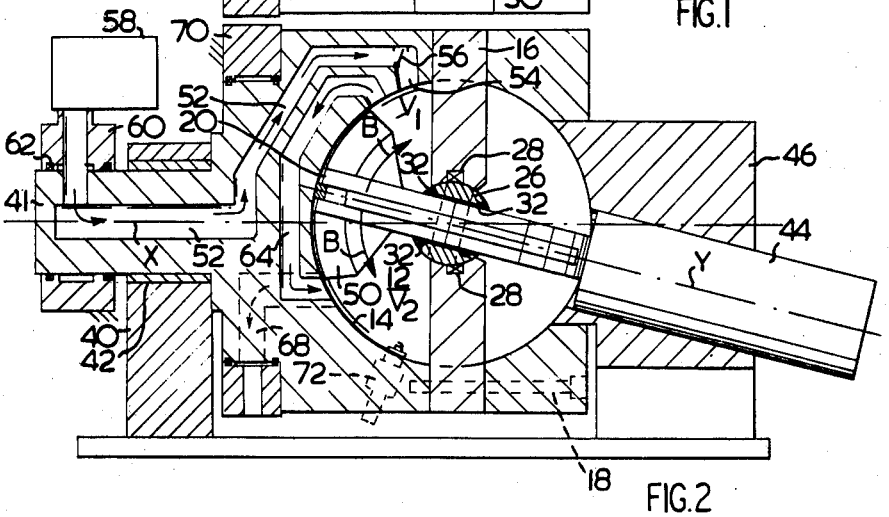
FIG. 2 is a sectional side elevation view of the two-cycle engine of FIG. 1 illustrating the principles of operation.

With reference to the drawings FIGS. 1 and 2 illustrate an apparatus according to the invention which is particularly adapted for use as a two-cycle engine. It will be seen in general that this apparatus includes a body 10 having a chamber 12 defined therein. The inner surface 14 of such chamber is in the form of a concave spherical segment. A partition 16 in the form of a heavy plate extends across the mouth of the chamber 12 and is sealingly connected thereto by means of suitable bolts 18. Suitable gaskets (not shown) prevent the escape of gases between body 10 and partition 16.

The partition 16 is provided with an elongated slot through which a baffle 20 extends. This baffle 20, as will be seen hereinafter, is in sealing engagement with partition 16 but is movable relative thereto. The baffle 20 has a peripheral edge 22 of circular form arranged to sealingly engage the inner surface 14 of chamber 12 in relatively movable relation thereto such as to permit the baffle 20 to sweep to and fro within chamber 12 while at the same time moving relative to the partition means. It will be seen that as the baffle 20 sweeps to and fro within the chamber it varies the volume of the regions located between the inner surface 14 of the chamber and the partition 16 on the opposing sides of the baffle 20. In order to effect a proper fluid seal between the outer peripheral edge 22 of baffle 20 and the inner surface 14 of the chamber, such outer peripheral edge is provided with an outwardly biased peripheral sealing means 24 which will perform much the same function as does a piston ring in a conventional internal combustion engine i.e., by preventing "blow by" of gases. Since such types of sealing arrangements are generally well known in the art, further description of same at this point is believed unnecessary.

Various port means communicate with the chamber 12 and suitable valve means are associated with these ports for permitting a desired inflow and outflow of gases from the chamber 12 during occurrence of the sweeping motion of the baffle 20 within chamber 12. These ports and valve means will be described in greater detail later on in the specification.

The baffle means 20 is connected to partition 16 by an arrangement which includes pivots defining intersecting pivot axes mutually perpendicular to one another. With reference to FIGS. 1 and 2 it will be seen that this pivot means includes an elongated cylindrical shaft 26 mounted in the partition means for angular motion therein around the longitudinal axis of the elongated shaft. Sealing means 28 between the partition and the shaft 26 prevent any blow by of gases. Additional end seals 20 also prevent blow by of gases between the outer peripheral edge 22 of baffle 20 and elongated shaft 26. The baffle 20, of course, extends through the elongated shaft via a suitably dimensioned longitudinally extending slot in the shaft. Additional longitudinally extending seal means 32 prevent blow by of gases between the surface of baffle 20 and the elongated shaft 26. Furthermore, it will be seen that a pivot pin 34 extends transversely of the longitudinal axis of shaft 26 and passes through the center of the baffle 20, the opposing ends of the pivot pin 34 being engaged in elongated shaft 26 whereby to permit oscillation of the baffle means 20 thereabout during the swepping motion of the baffle. Pivot 34 also carries spacers to assure clearance between sides of baffle and slot.

In the embodiment of FIGS. 1 and 2, both body 10 and baffle 20 rotate simultaneously. In order to provide for the sweeping motion of baffle 20 within chamber 12, body 10 is mounted via shaft 41 to a suitable rigid support 40 in bearings 42 for rotation about an axis designated X. The baffle 20 is rigidly connected to a shaft 44 which is journalled in a fixed support 46 for rotation about an axis Y which is angularly inclined to the rotation axis X of body 10. The angle of inclination is not critical; however, it will be realized that the angular extent of the sweeping motion of baffle 20 within chamber 12 will be a direct function of the angle of inclination between the rotation axes X and Y and thus this angle of inclination will be chosen so as to achieve the desired displacement and the desired compression ratios. It will also be noted that the rotation axes X and Y intersect at a point corresponding to the point of intersection of the mutually perpendicular pivot axes defined by the longitudinal axis of the above mentioned shaft 26 in partition 16 and the transverse pivot pin 34. As a practical matter, the rotation axes X and Y of body 10 and shaft 44 may make an angle of some 165° relative to one another. It should be appreciated that this angle may be varied by several degrees whereby to achieve the overall desired displacement effects and compression ratios mentioned above.

By virtue of the above described arrangement, it will be appreciated that as body 10 and shaft 44 rotates about their respective mutually inclined rotation axes X and Y, that a compound sweeping motion of baffle 20 will occur within chamber 12. With reference to FIG. 1, the baffle will oscillate around pivot 34 so as to produce the oscillation illustrated by the arrows A. At the same time, the baffle 20 will sweep to and fro within chamber 12 about the longitudinal axis of shaft 26, such sweeping motion being represented by the arrows B in FIG. 2. It is this sweeping motion illustrated by arrows B that is of significance as this motion varies the volumes of the regions located between the inner surface 14 of the chamber and the partition 16 on the opposing sides of baffle 20.

It will also be noted here that in order to obtain the desired displacement and compression effects, that the opposing faces of baffle 20 are provided with lobes 50. The exact shape and size of lobes 50 are not critical; however, it will be appreciated that they must be shaped so as to allow the most effective knockless and complete burning of low octane fuels during the short time of the combustion cycle of the engine. The shape of the lobes 50 will of course have to take into account the motion represented by arrows A as shown in FIG. 1 as well as the sweeping motion illustrated by arrows B in FIG. 2. By properly selecting the clearance between lobes 50 and the inner surface of the chamber and partition 16 the desired compression ratios can be achieved.

With particular reference to the function of the embodiment of FIGS. 1 and 2 as a two-cycle engine, the intake zone on one side of baffle 20 will be designated by the reference $V_1$ while the combustion zone on the opposite side of baffle 20 will be represented by the designation $V_2$. As mentioned previously the engine is provided with suitable port and valve means for permitting the desired inflow and outflow of gases from the chamber during operation of the two-cycle engine. It will therefore be seen that the mounting shaft 41 for rotary body 10 is provided with an intake port 52, which intake port 52 extends or passes through the body 10 and communicates with the interior of the chamber at an entrance port 54 closely adjacent the partition 16. This intake port 52 is provided with a suitable one-way inlet valve 56, for example a reed valve, for permitting one-way flow only of the fuel-air mixture. The fuel-air mixture is supplied to the intake ports 52 via a suitable carburetor 58 of conventional design which is connected to a stationary manifold 60. This stationary manifold comprises an annular body mounted to the outboard end of shaft 41 of rotary body 10. Suitable seal means 62 are provided intermedite shaft 41 and the intake manifold 60 to prevent dilution of the fuel-air mixture being supplied by carburetor 58. Centrifugal forces provide a partial "supercharging" effect.

In order to convey the compressed fuel-air mixture from the $V_1$ region i.e., the intake region, to the combustion zone $V_2$, an intermediate port 64 is provided as shown in FIG. 2. Preferably, this intermediate port 64 is arranged such that it enters the combustion zone $V_2$ at a point 66 well over to one side of the combustion zone as illustrated by the dotted lines in FIG. 1. The combustion zone $V_2$ is also provided with an exhaust outlet port 68, as best seen in FIG. 2 (in dotted lines) for the emission of spent combustion gases from the combustion chamber. In order that the exhaust gases may properly be collected, a stationary annular manifold 70 is mounted to the rotary body 10 and suitable sealing means are interposed therebetween to prevent undesired escape of exhaust gases. It is possible to arrange outlet port 68 so as to achieve a reaction turbine effect whereby to utilize the energy of the exhaust gases to exert additional torque on rotating body 10.

In order to ignite the compressed fuel-air mixture in the combustion zone $V_2$ a spark plug 72 is provided and those skilled in the art will realize that it will be a simple matter to provide rotating body 10 with a suitable slip ring contact for firing the spark plug at the appropriate point after the compression sweep of baffle 20. The spark ignition may be supplied by conventional means such as a magneto and breaker point arrangement.

The operation of the two-cycle engine will be self-evident from the drawings. During rotation of body 10 and shaft 44, the sweeping movement of baffle 20 in one direction will operate to increase the size of volume $V_1$ thus causing a fuel-air mixture to pass thereinto via the intake port 52. At the same time, a fuel-air charge previously introduced via intermediate conduit 64 into the combustion chamber $V_2$ is compressed after which spark plug 72 fires, thus expanding the gases therein and forcing baffle 20 in the opposite direction. At the end of the combustion stroke, the spent combustion gases exit via the exhaust port 68 while at the same time the well known "scavenging" action inherent in all two stroke engines occurs with a fuel-air mixture passing from $V_1$ through conduit 64 into the combustion chamber after which the above cycle is repeated thereby causing body 10 and shaft 44 to rotate. Suitable pulley or shaft means (not shown) are connected to either shaft 41 or shaft 44 so that the engine may perform useful work. Cooling means for the engine are not shown but air or liquid coolants may be used with coolant being supplied through shaft 41 in any suitable fashion.

Figure 3:
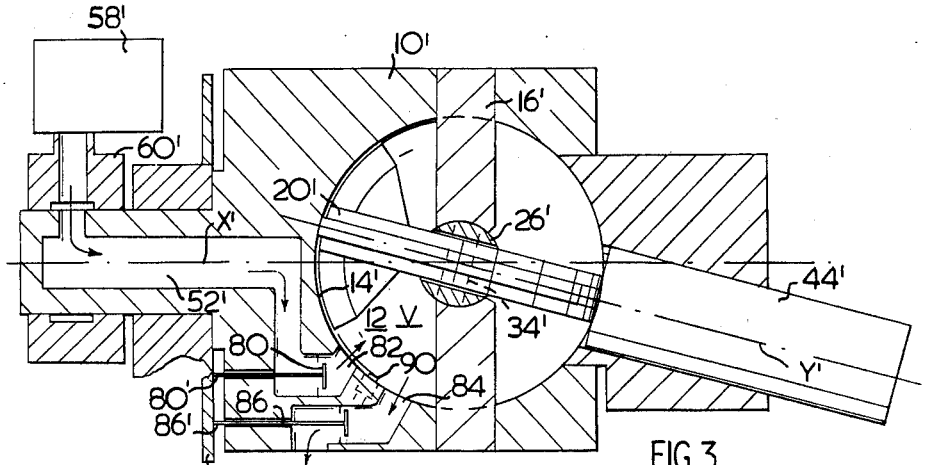
FIG. 3 is a sectional side elevation view of a fluid displacement device similar in overall principle to that of FIGS. 1 and 2 but with the valving and porting arrangements being such as to provide a four-cycle internal combustion engine.

FIG. 3 illustrates a four-cycle engine. It wil be seen from a review of this drawing that the basic structures concerned are identical to those of the embodiment of FIGS. 1 and 2. Only the valving and porting means have been modified. The remaining structures i.e., the rotating body 10' having therein a cavity or chamber in the form of a concave spherical segment, a partition 16' positioned over the mouth of such cavity and baffle means 20' mounted therein, the baffle being mounted to a shaft 44' and the body 10' being rotatable about axis X' which is inclined to the rotation axis Y' of shaft 44' are all arranged as described previously in connection with FIGS. 1 and 2. In addition, the embodiment of FIG. 3 employs a carburetor 58' connected to an annular intake manifold 60' as described previously, such intake manifold communicating with an intake port for fuel-air mixture (52'). The intake port 52' extends through body 10' and thence through a positively actuated intake valve 80 with the fuel-air mixture entering chamber V via the intake port 82. This same chamber V, which is defined on one side of baffle 20' is also connected to an exhaust port 84 having therein positively actuated exhaust valve 86. If desired, exhaust port 84 can be arranged to achieve the turbine effect mentioned in relation to the two cycle embodiment.

The intake valve 80 and the exhaust valve 86 are spring biased into the closed position by conventional valve spring means (not shown). In order to open these valves in timed relation to the sweeping motion of baffle 20', the inner end portions 80' and 86' of the valve stems, make contact with cam lobes (not shown) located at the approriate angular positions on a cam plate 88. Those skilled in the art will readily be able to determine the appropriate angular location of the cam lobes on cam plate 88 after reviewing the following brief description of the operation of the four-cycle engine of FIG. 3. It will be seen that as body 10' and shaft 44 rotate together that baffle 20' will sweep to and fro within the chamber 12'. As a result of this to and fro sweeping motion, the volume of space V will be varied accordingly. Thus, the cam lobe for actuating intake valve 80 will be arranged such that as volume V is increasing, such valve 80 is held in the open position thereby drawing a fuel-air mixture in through the intake port 82. Then, as soon as the intake cycle has been completed, intake valve 80 will close and, with further rotation of the body 10' and shaft 44' the baffle 20' will move in the opposite direction thereby decreasing the volume V and compressing the fuel-air mixture therein. At the appropriate point during the compression stroke, the spark plug 90 will be fired to ignite the charge thus expanding the fuel-air mixture therein and driving the baffle 20' in the opposite direction. The forces thus applied to the baffle 20' will serve to effect continued rotation of body 10' and shaft 44' and the next stage i.e., the exhaust stage will involve the baffle 20' again moving to decrease volume V at which point the exhaust valve 86 is opened by virtue of its contacting its respectively associated cam lobe whereby the spent gases exit via exhaust port 84. After completion of this, the exhaust valve closes and the intake valve opens thereby commencing a further cycle of the engine. As with the embodiment of FIGS. 1 and 2, a suitable stationary manifold may be provided to collect the exhaust gases so produced. As with the embodiment of FIGS. 1 and 2, a suitable power output pulley or shaft is connected to shaft 41' or shaft 44' so that the power output of the four-cycle engine may be used in any desired fashion.

Figure 4:
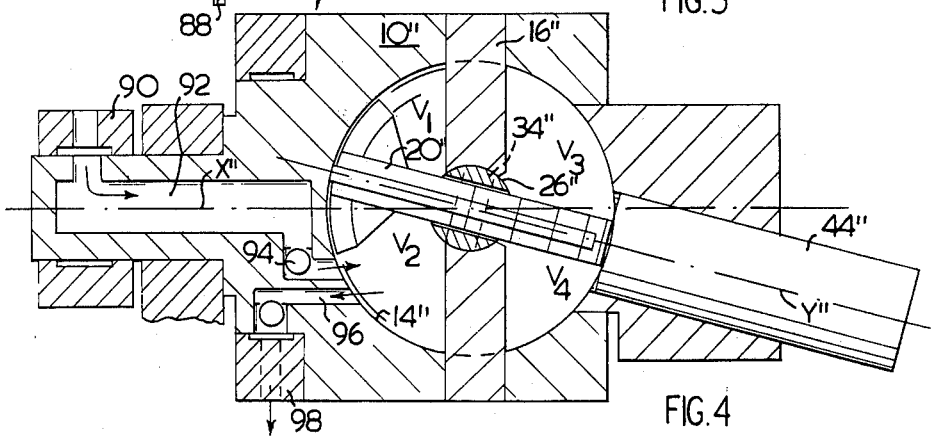
FIG. 4 is a sectional side elevation view of the invention wherein the valving and porting arrangements are such as to provide a fluid pump or compressor.

FIG. 4 illustrates a pump incorporating the principles of the invention; again, the basic structure of the device remains unchanged from that of FIGS. 1–3 except for the fact that the valving and porting arrangements have been modified. Thus, only the modified valving and porting arrangements will be described. It will be seen that the device is provided with a stationary inlet manifold 90 which communicates with an intake duct 92 extending within the rotary body 10''. Situated in intake duct 92 is a one-way check valve 94 which permits entrance of fluid into volume $V_2$ defined between baffle 20'', partition 16'' and inner spherical surface 14'' of the chamber. Thus, during rotation of shaft 44'' and body 10'', the fluid is drawn inwardly as volume $V_2$ increases during sweeping motion of baffle 20''. Then, as rotation of the above noted members continues, the baffle 20'' moves in the opposite direction whereupon the fluid in volume $V_2$ is forced outwardly through outlet port 96, the latter being provided with a one-way check valve to permit exit only of fluid from volume $V_2$. This port 96 communicates with a suitable stationary outlet manifold 98. It should be noted here that although, with the embodiment of FIG. 4, the inlet and outlet ports are shown as being associated with volume $V_2$ only, with suitable modifications, inlet and outlet ports may be connected to the remaining volume $V_1$ thereby to double the pumping capacity of the device. With additional valving and porting modifications such as shown in FIGS. 7 and 8 it should also be possible to make use of volumes $V_3$ and $V_4$ which are located on the opposite side of the partition means 16''.

In all of the embodiments thus far described, both the body having the chamber therein and the baffle are arranged to rotate together. In the embodiment according to FIG. 5, the chamber defining body 10''' is arranged so as to be stationary. The body 10''' contains, as before, a chamber, at least a portion of the inner surface of same being in the form of a concave spherical segment. In addition, as before, such chamber has a partition 16''' positioned over the mouth of same, such partition having an elongated shaft 26''' therein having an elongated slot as described previously through which a baffle 20''' passes. Such shaft is also provided with a transversely extending pivot pin 34''' so as to permit the baffle to oscillate about mutually perpendicular axes as its periphery sweeps the inner surface of the chamber in sealing relation therewith. Thus, the relative motions between baffle 20''' and body 10''' are identical with those described previously, the only difference being that the body 10''' does not rotate. This can prove to be advantageous in certain situations as it is now possible to dispense with the more complex manifold arrangements required when the chamber 10 is rotating. As mentioned above, the baffle 20''' passes through a slot in the shaft 26''' and also oscillates about a transverse pivot pin 34'''. Hence, during the sweeping motion of the baffle 20''' within stationary chamber 10''', the shaft 43, which is rigidly connected to baffle 20''' sweeps out a surface corresponding to the surface of a cone. In order to convert this motion to rotary motion it is necessary to employ a crank arrangement 100 which will convert this sweeping motion of shaft 43 to rotary output shaft motion, the output shaft being designated by reference numeral 44'''. Since the presence of the crank arrangement 100 will create a certain amount of dynamic imbalance, a counterweight 102 should be provided on the opposite side of the crank arrangement to prevent excessive vibration. If it is assumed that the embodiment of FIG. 5 is being utilized as a pump, the same will be provided with an inlet port 104 having a suitable inlet check valve associated therewith and an outlet port 105 having an outlet check valve provided therein and functioning in a manner very similar to that described above in connection with the embodiment of FIG. 4.

Figure 5:
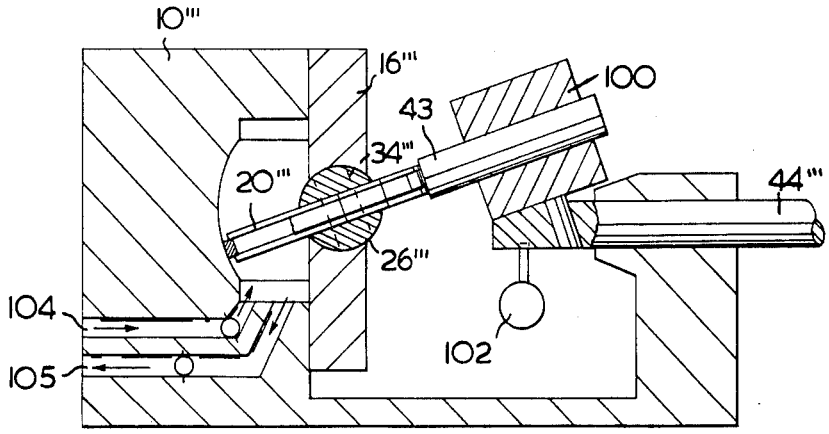
FIG. 5 is a representation of an alternative embodiment of the invention wherein the chamber is made stationary with the rotary shaft being operatively connected to the baffle.
Figure 6:
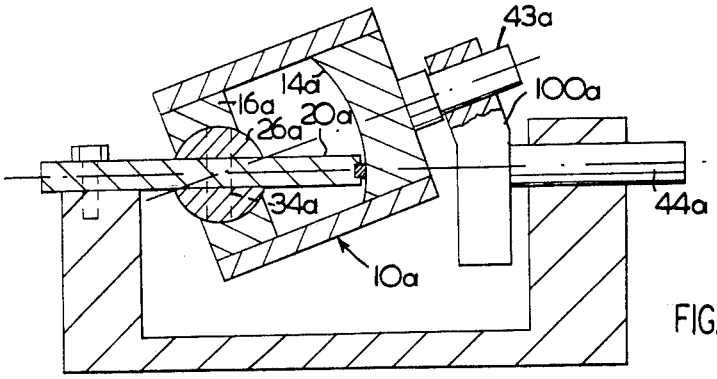
FIG. 6 is a diagrammatic longitudinal section view of an alternative arrangement wherein the baffle is stationary and the movable body operatively connected to rotatable shaft means.

The embodiment of FIG. 6 is essentially the inverse of the embodiment of FIG. 5. That is, the baffle **20*a* is fixed while the body 10 is connected to rotary crank 100*a* which, in turn, is attached to rotary output shaft 44*a*. As shaft 44*a* rotates, shaft 43*a*, rigidly connected to body 10*a* sweeps out a path corresponding to the surface of a cone thus causing relative sweeping motion between baffle 20*a* and body 10*a*, the latter having, as before, an internal concave spherical surface portion 14*a*. As with the previous embodiments, baffle 20*a* passes through a slot in shaft 26*a* mounted in partition 16*a* with pivot pin 34*a* and shaft 26*a* defining mutually transverse pivot axes about which body 10*a* moves relative to fixed baffle 10*a*. Baffle 10*a*** is provided with inlet and outlet ports and suitable check valves (not shown) enabling it to be used as a pump, for example.

Figure 7:
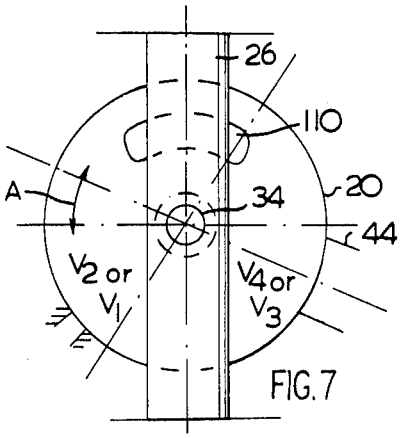
FIGS. 7 and 8 are diagrammatic views illustrating alternative forms of port and valve means for directing the fluid in a desired fashion during operation of the fluid displacement device.
Figure 8:
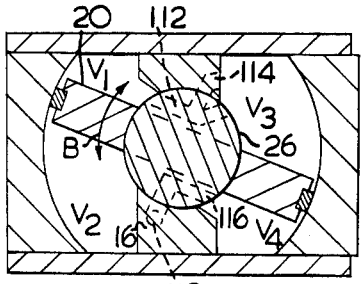

FIGS. 7 and 8 illustrate valving modifications which, with reference to FIG. 2 for example, permit any one of the four zones (V, $V_2$, $V_3$, or $V_4$) to be designated as the combustion chamber and paired with one of two intake zones. One combustion chamber can be paired with two intake chambers and vice versa. One way of providing a communication between zones on opposite sides of partition 16 is shown in FIG. 7 where an arcuate groove 110 is machined partway into baffle 20. Groove 110 is of such angular extent as to permit flow of gases from $V_2$ or V, to $V_3$ or $V_4$ (depending on which side of baffle 20 is grooved) during selected portions of the oscillation of baffle 20 about the pivot 34 in the direction of arrow A. In FIG. 8 ports 112 and 114 are arranged in shaft 26 and partition 16 respectively to provide communication between zone V, with $V_3$ during selected portions of the sweeping motion of the baffle 20 relative to the body 10. In like fashion, ports 116 and 118 in shaft 26 and partition 16, connect zone $V_4$ with the partition (and the external atmosphere) during selected portions of the sweeping motion of the baffle in such cases where a connection of this type is desired.

Figure 9:
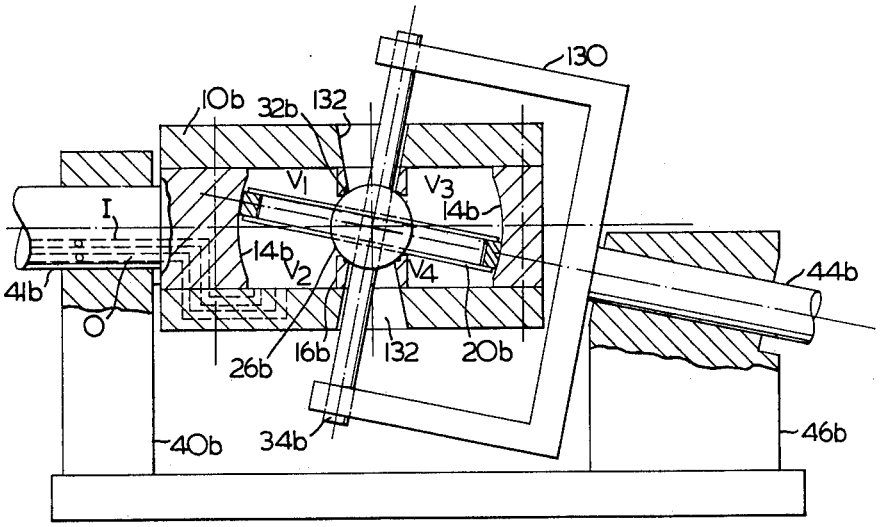
FIGS. 9 and 10 are diagrammatic longitudinal section views of still further embodiments of the invention.

FIG. 9 shows a further modification in which the baffle **20*b* is fixed relative to the shaft 26*b*, the latter oscillating about its axis relative to partition 16*b* as shafts 44*b* and 41*b* are rotated. The shaft 44*b* is connected to elongated pivot pin 34*b* via fork 130 with pivot pin 34 oscillating about its axis relative to shift 26*b* during operation. A primary difference between this embodiment and the other embodiments described is that the interior surfaces 14*b* against which the baffle 20*b* makes contact are not spherical segments but rather are cylindrical surface segments whose centerline coincides with the oscillation axis of shaft 26*b*. (alternatively surfaces 14*b* could be oval, elliptical etc. in a plane coinciding with the axis of shaft 26*b*) Suitable recesses 132 are provided in body 10*b* to permit the required oscillation of the pivot pin 34*b* relative to body 10*b* during operation of the device while at the same time the baffle 20*b* sweeps back and forth in the chamber thus changing the relative sizes of the four zones $V_1$, $V_2$, $V_3$ and $V_4$. Suitable inlet and outlet ports for these zones are provided depending on the end use for the apparatus. The dashed lines in FIG. 9** indicate inlet and outlet ports I and O for zone $V_2$. Similar inlet and outlet ports for the other chambers $V_1$, $V_3$, $V_4$ may also be provided.

Figure 10:
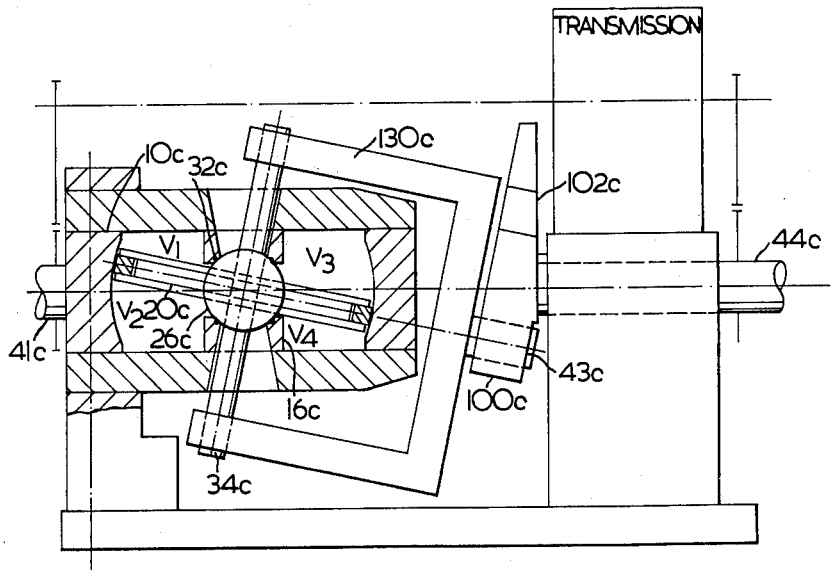

The embodiment depicted in FIG. 10 is essentially the same as that of FIG. 9 except that the shaft **44*c* is not angularly disposed relative to shaft 41*c* but, rather is parallel thereto with a crank assembly 100*c* connecting shaft 44*c* to the forked member 130*c* via pin 43*c* which is free to rotate within an aperture provided in crank 100*c*. Shaft 41*c* may be locked against rotation and shaft 44*c* used to transmit power to or from the device depending on its end use. If shafts 41*c* and 44*c* are driven in opposite directions the number of working cycles will be increased; if driven in the same direction at different speeds the number of working cycles will decrease. If shafts 41*c* and 44*c* are driven in the same direction at the same speed, the baffle 20*c* will not oscillate and no useful work will be done. Any form of transmission means may be connected to shaft 44*c* and/or 41*c* to transmit rotary motion as desired. The inlet and outlet ports for zones $V_1$, $V_2$, $V_3$, $V_4$ are not shown in FIG. 10;** these will be arranged in accordance with end use selected for the device eg. pump, I.C. engine, etc;

It will thus be seen that the apparatus of the present invention is adaptable to a wide variety of uses i.e., it may be used as a simple fluid pump or compressor, pneumatic or hydraulic motor or alternatively as either a two-cycle or a four-cycle internal combustion engine. Other modifications and variations will be apparent to those skilled in the art and it will be realized that the described embodiments are illustrative examples only and that for a full appreciation of the invention reference is to be had to the claims appended hereto.

I claim:

1. A fluid displacement apparatus comprising:

a. a body having a chamber defined therein, at least a portion of the inner surface of such chamber being in the form of a concave spherical segment and having an axis of symmetry, b. partition means sealingly engaged with said chamber and defining an enclosed space therewith, c. a baffle defining an imaginary plane extending through said partition means in sealing engagement therewith and movable relative thereto about pivot means defining a first pivot axis lying in the plane defined by said baffle, the orientation of the first pivot axis being fixed relative to said chamber and located in an imaginary plane defined by said partition and perpendicular to and intersecting the axis of symmetry of the chamber, d. said baffle having a peripheral edge, a portion of which defines an arc of a circle to sealingly engage said inner surface of said chamber in relatively movable relation thereto such that said baffle is capable of oscillating motion relative to said chamber about said first pivot axis whereby to vary the volumes of the regions located between said inner surface and said partition on the opposing sides of said baffle, said baffle defining an axis lying in the plane of the baffle and intersecting said first pivot axis, e. port means and valve means communicating with said chamber for permitting or effecting inflow and outflow of fluid from said chamber in a selected fashion during the occurrence of said oscillating motion of said baffle relative to said chamber, and f. rotatable shaft means operatively connected to said baffle and/or said chamber for rotation of said shaft means about an axis coinciding with said axis defined by the baffle and/or said axis of symmetry defined by the chamber during said oscillating motion of the baffle relative to said chamber whereby the oscillating motion of the baffle relative to the chamber effects rotation of the shaft means or vice versa.

2. Apparatus according to claim 1 wherein said fluid displacement apparatus comprises a fluid pump, said port means including an intake port having a one-way valve for admission of fluid into at least one of said regions during motion of said baffle in one directon, and an exhaust port having a one-way valve for allowing exit of fluid from said at least one region during motion of said baffle in the opposite direction.

3. Apparatus according to claim 1 wherein said port means and valve means are arranged to provide a pneumatic or hydraulic pump or motor.

4. Apparatus according to claim 1 wherein said baffle is connected to said partition means by said pivot means, said pivot means also defining a second pivot axis about which said baffle pivots relative to said chamber, said first and second pivot axes intersecting one another and being mutually perpendicular to one another.

5. Apparatus according to claim 4 wherein said pivot means comprises an elongated shaft mounted in said partition means for angular motion therein to define said first pivot axis, said elongated shaft having a longitudinally extending slot therein through which said baffle passes in sealing relation therewith, and a pivot pin defining said second pivot axis extending transversely of said slot and passing through said baffle and engaged in said elongated shaft for pivoting of said baffle thereabout during said oscillating motion of the baffle.

6. Apparatus according to claim 4 further including means mounting said body for rotation about a rotation axis corresponding to said axis of symmetry, said baffle being rotatable and having a rotation axis corresponding with the baffle axis angularly inclined to the rotation axis of said body whereby said body and said baffle rotate simultaneously about their respective angularly inclined axes with said oscillating motion of said baffle within said chamber occurring during said rotation of the body and the baffle.

7. Apparatus according to claim 6 wherein said angularly inclined rotation axes of the body and the baffle intersect at a point coincident with the point of intersection of said mutually perpendicular first and second pivot axes defined by said pivot means.

8. A fluid displacement apparatus comprising:

a. a body having a chamber defined therein at least a portion of the inner surface of such chamber being in the form of a concave spherical segment and having an axis of symmetry, b. partition means sealingly engaged with said chamber and defining an enclosed space therewith, c. a baffle defining an imaginary plane arranged in sealing engagement with said partition means and movable relative to the chamber about pivot means defining a first pivot axis lying in the plane defined by the baffle, d. said baffle having a peripheral edge, a portion of which defines an arc of a circle to sealingly engage said inner surface of said chamber in relatively movable relation thereto such that said baffle is capable of oscillating motion relative to said chamber about said first pivot axis whereby to vary the volumes of the regions located between said inner surface and said partition on the opposing sides of said baffle, said baffle defining an axis lying in the plane of the baffle and intersecting the first pivot axis, e. port means and valve means communicating with said chamber for permitting or effecting inflow and outflow of fluid from said chamber in a selected fashion during the occurrence of said oscillating motion of said baffle relative to said chamber, and f. rotatable shaft means operatively connected to said baffle and/or said chamber for rotation of said shaft means about an axis coincident with said axis defined by the baffle and/or said axis of symmetry defined by the chamber during said sweeping motion of the baffle relative to said chamber whereby the sweeping motion of the baffle relative to the chamber effects rotation of the shaft means of vice versa.

9. Apparatus according to claim 8 wherein the first pivot axis is perpendicular to the axis of symmetry of the chamber.

* * * * *